US011771967B2

(12) United States Patent
Goji et al.

(10) Patent No.: US 11,771,967 B2
(45) Date of Patent: Oct. 3, 2023

(54) GOLF CLUB GRIP AND GOLF CLUB

(71) Applicant: Sumitomo Rubber Industries, Ltd., Hyogo (JP)

(72) Inventors: Sho Goji, Kobe (JP); Kazuyoshi Shiga, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 0 days.

(21) Appl. No.: 17/258,824

(22) PCT Filed: Jun. 19, 2019

(86) PCT No.: PCT/JP2019/024227
§ 371 (c)(1),
(2) Date: Jan. 8, 2021

(87) PCT Pub. No.: WO2020/026625
PCT Pub. Date: Feb. 6, 2020

(65) Prior Publication Data

US 2021/0268350 A1 Sep. 2, 2021

(30) Foreign Application Priority Data

Jul. 30, 2018 (JP) ..... 2018-142569

(51) Int. Cl.
*A63B 53/14* (2015.01)
*A63B 60/06* (2015.01)
*A63B 60/08* (2015.01)

(52) U.S. Cl.
CPC ..... *A63B 53/14* (2013.01); *A63B 60/06* (2015.10); *A63B 60/08* (2015.10)

(58) Field of Classification Search
CPC ..... A63B 53/14; A63B 53/00; A63B 60/08; A63B 60/14; A63B 60/06; A63B 60/18
(Continued)

(56) References Cited

U.S. PATENT DOCUMENTS 4,108,436 A * 8/1978 Masi ..... A63B 49/08 473/538
4,974,846 A * 12/1990 Fenton ..... A63B 53/14 473/303

(Continued)

FOREIGN PATENT DOCUMENTS

JP H02-049569 * 4/1990 ..... A63B 53/14
JP H0249569 U 4/1990

(Continued)

OTHER PUBLICATIONS

International Search Report issued in PCT/JP2019/024227; dated Sep. 10, 2019.

(Continued)

*Primary Examiner* — John E Simms, Jr.
(74) *Attorney, Agent, or Firm* — Studebaker & Brackett PC

(57) ABSTRACT

[Problem] To provide a golf club grip having excellent anti-slipping performance, and feeling when the grip is wet, and further to provide a golf club grip having excellent durability and an improved head speed. [Solution] The golf club grip comprises a cylindrical portion for inserting a shaft, wherein the golf club grip has a narrow groove region comprising narrow grooves in an occupation ratio of 35% or more per 25 $mm^2$ at at least a part of a surface of the cylindrical portion, and the narrow groove has a width (w) of from 0.1 mm to 0.7 mm and a depth (h) of from 0.1 mm to 1.0 mm. In addition, an interval (d) between the narrow grooves are preferably 1.5 mm or less.

20 Claims, 6 Drawing Sheets

(58) Field of Classification Search
USPC ..... 473/298, 299, 300, 302, 303
See application file for complete search history.

(56) References Cited

U.S. PATENT DOCUMENTS

| | | | | |
|---|---|---|---|---|
| 5,087,042 | A * | 2/1992 | Solheim | A63B 53/14 473/303 |
| 5,234,740 | A | 8/1993 | Reeves et al. | |
| 5,248,141 | A * | 9/1993 | Kelly | A63B 60/14 473/303 |
| 5,261,665 | A * | 11/1993 | Downey | A63B 60/08 473/303 |
| 5,637,043 | A * | 6/1997 | Fortis | A63B 60/14 473/302 |
| 5,926,653 | A * | 7/1999 | Nagasaka | G03B 17/02 396/6 |
| 6,610,382 | B1 * | 8/2003 | Kobe | A63B 53/14 428/119 |
| 2002/0142857 | A1 * | 10/2002 | Huang | A63B 53/14 473/300 |
| 2003/0088946 | A1 * | 5/2003 | Ferguson | B29C 33/42 16/431 |
| 2003/0216192 | A1 * | 11/2003 | Chu | A63B 53/14 473/300 |
| 2007/0082748 | A1 * | 4/2007 | Rose | A63B 53/14 473/300 |
| 2009/0143163 | A1 * | 6/2009 | Kumamoto | A63B 60/52 473/303 |
| 2014/0066222 | A1 * | 3/2014 | Huang | A63B 53/14 473/300 |
| 2014/0162804 | A1 * | 6/2014 | Wragg | A63B 53/14 473/303 |
| 2016/0107051 | A1 * | 4/2016 | Huang | A63B 53/14 156/187 |
| 2017/0182386 | A1 * | 6/2017 | Inoue | C08K 5/14 |
| 2019/0118367 | A1 * | 4/2019 | Davis | B25G 1/01 |

FOREIGN PATENT DOCUMENTS

| | | | |
|---|---|---|---|
| JP | H0343866 | U | 4/1991 |
| JP | H0615019 | A | 1/1994 |
| JP | 2005508769 | A | 4/2005 |
| JP | 4606491 | B2 | 1/2011 |
| JP | 2011030938 | A | 2/2011 |
| JP | 2012170532 | A | 9/2012 |
| JP | 2013066630 | A | 4/2013 |
| JP | 2016214704 | A | 12/2016 |

OTHER PUBLICATIONS

The extended European search report issued by the European Patent Office dated Jan. 26, 2022, which corresponds to European Patent Application No. 19843579.4-1122 and is related to U.S. Appl. No. 17/258,824.

* cited by examiner

GOLF CLUB GRIP AND GOLF CLUB

FIELD OF THE INVENTION

The present invention relates to a golf club grip.

DESCRIPTION OF THE RELATED ART

A golf club is composed of a shaft, a head provided at the front end of the shaft, and a grip for inserting the back end of the shaft. The grip is a part where the golfer holds the golf club with hand when swinging the golf club, and plays an extremely important role in transferring the movement of the golfer to the golf club. Examples of the important performance required by the grip include suppression in slipping between the hand of the golfer and the grip in the swing.

Generally, the grip is formed from a soft material such as a rubber or a synthetic resin, and further has a pattern of groove or concave formed on the surface thereof for improving anti-slipping performance (for example, refer to paragraph 0035 and FIG. 4 of the patent document 1).

In addition, the patent document 2 discloses a grip having a stem arrangement formed at the grip surface, wherein the stem arrangement has different zones of stems, with the stems having different heights in different zones (refer to paragraphs 0040 to 0043 of the patent document 2). In the grip disclosed in the patent document 2, a stem having a height of about 0.020 to about 0.030 inch (0.508 to 0.762 mm) is formed in the first zone.

PRIOR DOCUMENT

Patent Document

Patent document 1: Japanese Patent Publication No. 2016-214704 A

Patent document 2: Japanese Patent Publication No. 2005-508769 A

SUMMARY OF THE INVENTION

Problem to be Solved by Invention

The patent document 2 discloses that fine protrusions are formed at the grip surface to improve the anti-slipping performance of the grip. However, in case of the fine protrusions, the depth of the groove between the protrusions is required to be small to maintain the strength of the protrusions. Thus, the moisture such as sweat of the golfer and rain is easily retained in the fine protrusions, and the grip surface tends to have lowered dryness.

The present invention has been made in view of the above circumstances. An object of the present invention is to provide a golf club grip having excellent anti-slipping performance, and feeling when the grip is wet.

Solution for Solving Problem

The present invention that can solve the above problem provides a golf club grip comprising a cylindrical portion for inserting a shaft, wherein the golf club grip has a narrow groove region comprising narrow grooves in an occupation ratio of 35% or more per 25 $mm^2$ at at least a part of a surface of the cylindrical portion, and the narrow groove has a width (w) of from 0.1 mm to 0.7 mm and a depth (h) of from 0.1 mm to 1.0 mm.

The grip has a narrow groove region where a certain amount of narrow grooves with a specific width and a specific depth are formed. The narrow groove region can take the moisture such as sweat of the golfer or rain into the inner side of the narrow groove, thereby keeping the grip surface in a dry state. In addition, the island portion formed by the separation of the narrow groove is hooked by the skin of the user, thus the grip has further anti-slipping performance.

The present invention also provides a golf club comprising a shaft, a head provided on one end of the shaft, and a grip provided on another end of the shaft, wherein the grip is the above-described golf club grip.

Effect of Invention

According to the present invention, a golf club grip having excellent anti-slipping performance, and feeling when the grip is wet, is obtained.

DESCRIPTION OF THE PREFERRED EMBODIMENT

Figure 1:
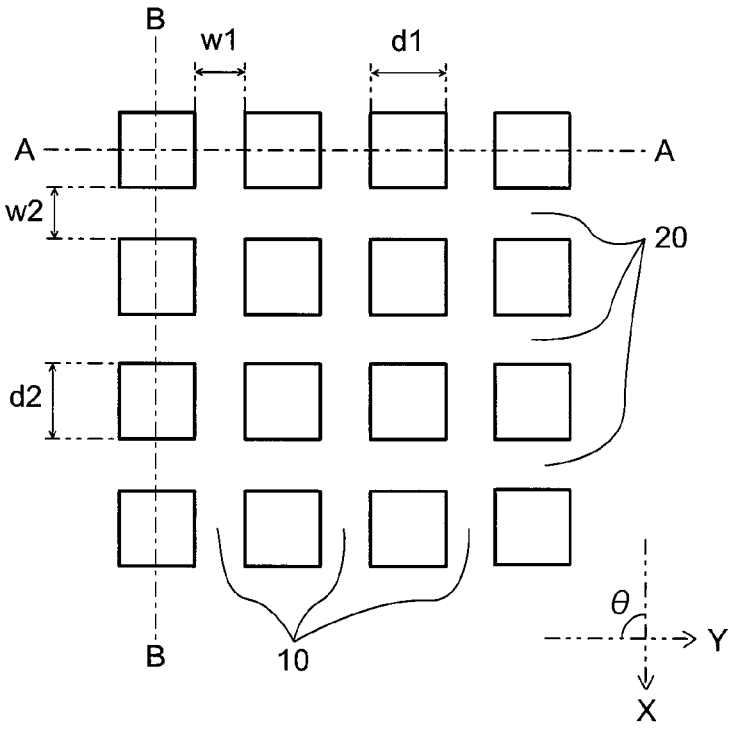
FIG. 1 is view showing one example of a narrow groove region.

The present invention provides a golf club grip comprising a cylindrical portion for inserting a shaft, wherein the golf club grip has a narrow groove region comprising narrow grooves in an occupation ratio of 35% or more per 25 $mm^2$ at at least a part of a surface of the cylindrical portion. The grip has a narrow groove region where a certain amount of narrow grooves with a specific width and a specific depth are formed. The narrow groove region can take the moisture such as sweat of the golfer or rain into the inner side of the narrow groove, thereby keeping the grip surface in a dry state. In addition, the island portion formed by the separation of the narrow groove is hooked by the skin of the user, thus the grip has further anti-slipping performance.

(Narrow Groove Region)

The narrow groove region is a region where a specific narrow groove is formed in a certain occupation ratio. The occupation ratio of the narrow groove at the narrow groove region is 35% or more, preferably 38% or more, more preferably 40% or more, and is preferably 65% or less, more preferably 60% or less, and even more preferably 55% or less, per 25 $mm^2$ (a square of 5 mm×5 mm). If the occupation ratio of the narrow groove is 35% or more, water hardly overflows from the narrow groove, and the feeling when the grip is wet is better. In addition, if the occupation ratio of the narrow groove is 65% or less, slipping by the lowering in the contact area is not felt, and the anti-slipping performance is better. It is noted that the occupation ratio is a proportion of the area of the narrow groove per unit area. The area of the narrow groove may be measured by observing the surface of the grip with a microscope, or be calculated based on the width (w), length and number of the narrow groove at the grip surface. It is noted that a groove other than the narrow groove, which will be described later, may be formed at the narrow groove region, and only the area of the narrow groove is calculated when calculating the above described area.

The width (w) of the narrow groove formed at the narrow groove region ranges from 0.1 mm to 0.7 mm. If the width of the narrow groove falls within the above range, the moisture such as sweat of the golfer is more easily taken into the inner side of the narrow groove. The width of the narrow groove is preferably 0.2 mm or more, more preferably 0.3 mm or more, and is preferably 0.6 mm or less, more preferably 0.5 mm or less. The width of the narrow groove is a width measured at the surface of the grip. The measurement can be performed with a micrometer or the like.

The depth (h) of the narrow groove ranges from 0.1 mm to 1.0 mm. If the depth of the narrow groove falls within the above range, the moisture such as sweat of the golfer is more easily taken into the inner side of the narrow groove. The depth of the narrow groove is preferably 0.2 mm or more, more preferably 0.3 mm or more, and is preferably 0.8 mm or less, more preferably 0.7 mm or less. It is noted that the width of the groove may be fixed in the depth direction, or the width at the grip surface may be different from the width at the deepest position. The width of the groove may become smaller as the depth of the groove becomes greater, or may become smaller stepwise. The ratio (wd/ws) of the width (wd) of the narrow groove at the deepest position to the width (ws) of the narrow groove at the grip surface is preferably 1.0 or less, more preferably 0.8 or less, and even more preferably 0.6 or less. Examples of the cross-sectional shape of the groove include a V shape, a roughly V shape, and a U shape.

The narrow groove region may have one type of narrow groove formed in a multiple number, or have multiple types of narrow groove formed in combination. Examples of the shape of the narrow groove include, but are not particularly limited to, a linear shape and a curved shape, but the linear shape is preferable. In addition, the width and depth of the narrow groove are preferably fixed.

At the narrow groove region, the average length of the narrow groove is preferably 10 mm or more, more preferably 20 mm or more, and even more preferably 30 mm or more. If the average length of the narrow groove is 10 mm or more, the moisture taken into the narrow groove can be diffused inside the narrow groove, the moisture such as sweat of the golfer is more easily taken into the inner side of the narrow groove.

At the narrow groove region, the interval (d) between the narrow grooves is preferably 1.5 mm or less, more preferably 1.2 mm or less, and even more preferably 1.0 mm or less. If the interval between the narrow grooves is 1.5 mm or less, the island portion formed between the narrow grooves is more easily hooked by the skin, and the feeling is better. Thus, the force of the user holding the grip becomes weak unconsciously, and the resistance of human body to the swing becomes low, so that the head speed is enhanced. In addition, when a plurality of narrow grooves are formed in parallel to each other, the interval (d) between the narrow grooves is preferably 0.3 mm or more, more preferably 0.4 mm or more, and even more preferably 0.5 mm or more. If the interval (d) between the narrow grooves is 0.3 mm or more, the island portion formed between the narrow grooves has greater mechanical strength and further enhanced durability. It is noted that the interval between the narrow grooves may be fixed or different from each other.

The ratio (d/w) of the interval (d) between the narrow grooves to the width (w) of the narrow groove is preferably 1 or more, more preferably 1.5 or more, and even more preferably 2 or more, and is preferably 5 or less, more preferably 4.5 or less, and even more preferably 4 or less. If the ratio (d/w) falls within the above range, the feeling in the hitting is better.

The narrow groove preferably intersects with another narrow groove. If the narrow grooves intersect with each other, sweat or rain taken into the narrow groove can be diffused to another narrow groove, and the grip surface can be kept in a drier state. In addition, the grip surface preferably has an island portion formed by the separation of the narrow groove. The island portion formed by the separation of the narrow groove is hooked by the skin of the user, thus the anti-slipping performance is enhanced. The narrow groove preferably has a first narrow groove group formed in parallel to each other, and a second narrow groove group intersecting with the first narrow groove group and formed in parallel to each other. If the first narrow groove group and the second narrow groove group are formed, the occupation ratio of the narrow groove is more easily controlled.

When the first narrow groove group and the second narrow groove group are formed, the angle formed between them is preferably 45° or more, more preferably 60° or more, and even more preferably 80° or more, and is preferably 135° or less, more preferably 120° or less, and even more preferably 100° or less. If the angle formed between these narrow groove groups falls within the above range, the island portion formed between the narrow groove groups has greater mechanical strength and further enhanced durability.

When a tip side end of the cylindrical portion is adopted as 0%, and a bat side end of the cylindrical portion is adopted as 100%, the narrow groove region is preferably formed at at least a part of a range of from 10% to 100% of the cylindrical portion, more preferably formed at a range of from 15% to 80% of the cylindrical portion, and even more preferably formed at a range of from 20% to 70% of the cylindrical portion.

The narrow groove region is particularly preferably formed at an entire range of from 10% to 60% of the cylindrical portion. In this case, in the surface area of the entire range of from 10% to 60% of the cylindrical portion, the area ratio of the narrow groove region is preferably 30 area % or more, more preferably 40 area % or more, and even more preferably 50 area % or more, and is preferably 95 area % or less, more preferably 90 area % or less, and even more preferably 85 area % or less. The entire range of from 10% to 60% of the whole length in the axis direction distant from the tip side end is a part where the user holds the grip with hand. If this portion has the narrow groove region, the grip has better touch feeling.

The narrow groove region is preferably continuously formed in the peripheral direction of the cylindrical portion. If the narrow groove region is formed as this, sweat of the golfer or the like taken into the narrow groove is more easily diffused. It is noted that "continuously formed in the peripheral direction" includes not only an embodiment "continuously formed in a line in the peripheral direction", but also an embodiment "continuously formed in a V shape or U shape in the peripheral direction". The length of the narrow groove region in the peripheral direction is preferably 10% or more of the perimeter of the cylindrical portion, more preferably 20% or more of the perimeter of the cylindrical portion, and even more preferably 30% or more of the perimeter of the cylindrical portion, and is preferably 100% or less of the perimeter of the cylindrical portion.

The narrow groove region may be formed at only one position or at multiple positions. The total area of the narrow groove region is preferably 1400 $mm^2$ or more, more preferably 2800 $mm^2$ or more, and even more preferably 4200 $mm^2$ or more. If the total area is 1400 $mm^2$ or more, the feeling is better, and the head speed is enhanced. In addition, the area of each narrow groove region is preferably 180 $mm^2$ or more, more preferably 360 $mm^2$ or more, and even more preferably 540 $mm^2$ or more.

The narrow groove region can be formed by a laser processing method or a method of transferring from a mold, and is preferably formed by the laser processing method. The narrow groove can be more easily formed by the laser processing method.

Figure 2:
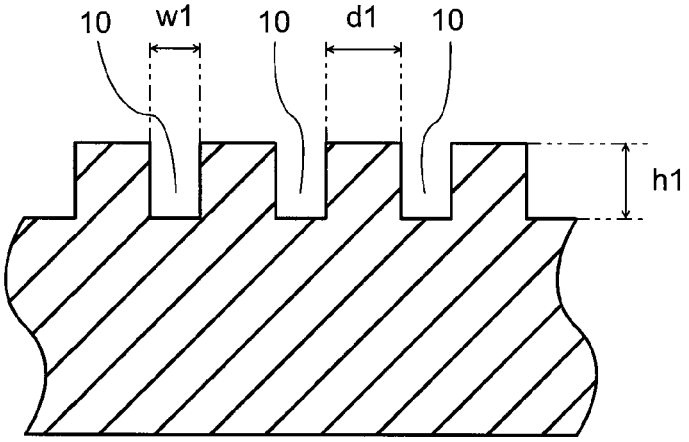
FIG. 2 is an A-A cross-sectional view of the narrow groove region shown in FIG. 1.
Figure 3:
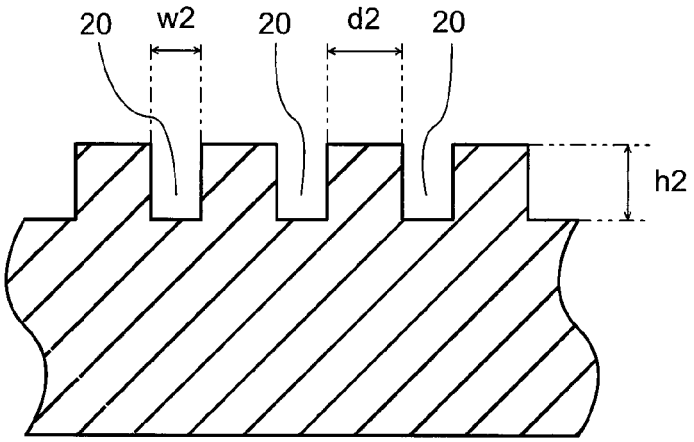
FIG. 3 is a B-B cross-sectional view of the narrow groove region shown in FIG. 1.
Figure 4:
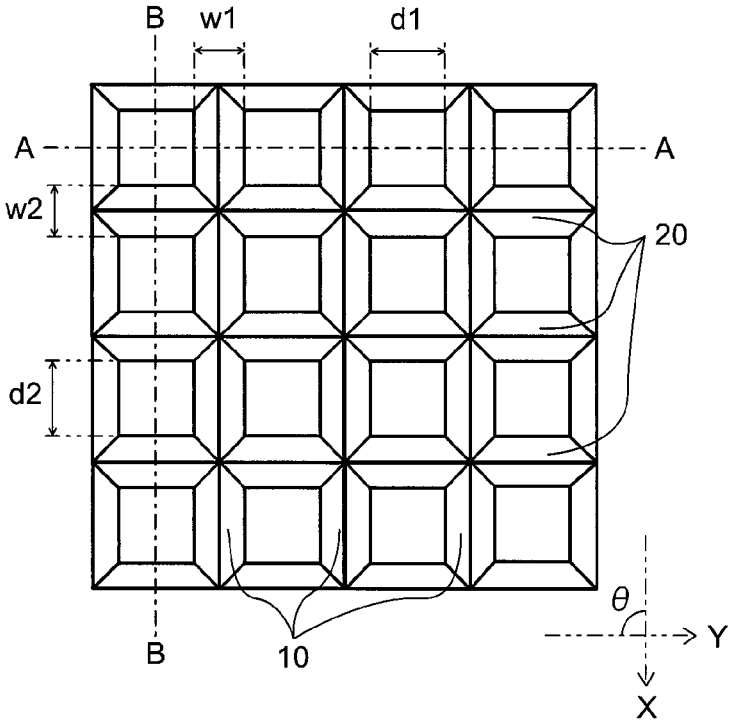
FIG. 4 is a view showing another example of a narrow groove region.
Figure 5:
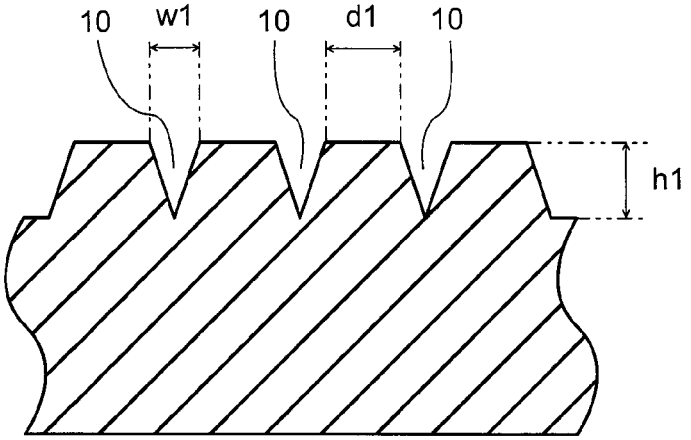
FIG. 5 is an A-A cross-sectional view of the narrow groove region shown in FIG. 4.
Figure 6:
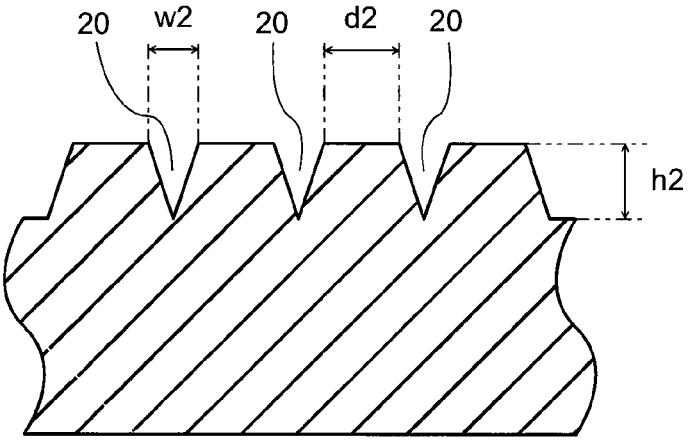
FIG. 6 is a B-B cross-sectional view of the narrow groove region shown in FIG. 4.
Figure 7:
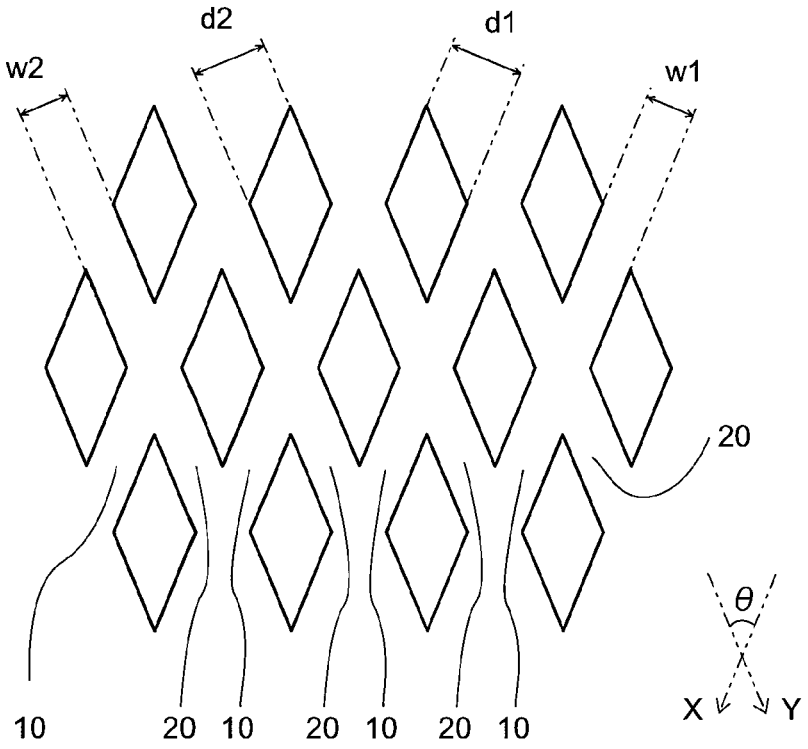
FIG. 7 is a view showing another example of a narrow groove region.

The narrow groove formed at the narrow groove region will be explained with reference to FIGS. 1 to 7. FIG. 1 is plan view showing one example of a narrow groove region. FIG. 2 is an A-A cross-sectional view of the narrow groove region shown in FIG. 1. FIG. 3 is a B-B cross-sectional view of the narrow groove region shown in FIG. 1. FIG. 4 is a plan view showing another example of a narrow groove region. FIG. 5 is an A-A cross-sectional view of the narrow groove region shown in FIG. 4. FIG. 6 is a B-B cross-sectional view of the narrow groove region shown in FIG. 4. FIG. 7 is a plan view showing another example of a narrow groove region.

At the narrow groove region shown in FIGS. 1, 4 and 7, a first narrow groove group 10 and a second narrow groove group 20 are formed. The first narrow groove group 10 has a fixed width W1 and a fixed interval d1. The second narrow groove group 20 has a fixed width W2 and a fixed interval d2. In addition, at the narrow groove region shown in FIGS. 1, 4 and 7, the width w1 of the first narrow groove group 10 is same as the width w2 of the second narrow groove group 20, and the interval d1 of the first narrow groove group 10 is same as the interval d2 of the second narrow groove group 20.

At the narrow groove region shown in FIGS. 1 and 4, when the direction of the first narrow groove group 10 is adopted as X, and the direction of the second narrow groove group 20 is adopted as Y, an angel 8 formed between the first narrow groove group 10 and the second narrow groove group 20 is 90°. Thus, a shape in a plan view of an island portion formed by the narrow groove is a square.

At the narrow groove region shown in FIG. 1, the width w1 of the first narrow groove group 10 and the width w2 of the second narrow groove group 20 are fixed in a depth direction. Thus, a cross-sectional shape of the island portion formed by the narrow groove is a quadrangular prism. At the narrow groove region shown in FIG. 4, the width w1 of the first narrow groove group 10 and the width w2 of the second narrow groove group 20 become smaller as the depths thereof become greater. Thus, a cross-sectional shape of the island portion formed by the narrow groove is a truncated quadrangular pyramid.

At the narrow groove region shown in FIG. 7, when the direction of the first narrow groove group 10 is adopted as X, and the direction of the second narrow groove group 20 is adopted as Y, an angel 8 formed between the first narrow groove group 10 and the second narrow groove group 20 is 45°. Thus, a shape in plan view of an island portion formed by the narrow groove is a rhombus.

[Construction]

The cylindrical portion of the golf club grip may be single layered or multiple layered. When the cylindrical portion is single layered, the narrow groove region and other region (hereinafter, sometimes simply referred to as "other region".) than the narrow groove region may be formed from a composition different from or identical to each other. It is noted that the narrow groove region and other region of the single layered cylindrical portion are both preferably solid.

When the cylindrical portion is multiple layered, the cylindrical portion has an outermost surface layer and at least one inner layer. The outermost surface layer has the narrow groove region. Herein, the outermost surface layer is an outermost layer of the grip, i.e. a layer touched by the user when using the grip. The narrow groove region and other region of the outermost surface layer may be formed from a composition different from or identical to each other. It is noted that the narrow groove region and other region of the outermost surface layer are both preferably solid. At least one layer of the inner layer is preferably a porous layer. When the cylindrical portion is multiple layered, a dual-layered construction composed of the outermost surface layer and a single layered inner layer; and a triple-layered construction composed of the outermost surface layer and a dual layered inner layer are preferred.

The thickness of the cylindrical portion is preferably 0.5 mm or more, more preferably 1.0 mm or more, and even more preferably 1.5 mm or more, and is preferably 17.0 mm or less, more preferably 10.0 mm or less, and even more preferably 8.0 mm or less. The cylindrical portion may be formed with a fixed thickness in the axis direction, or may be formed with a thickness gradually becoming thicker from the front end toward the back end.

When the thickness of the cylindrical portion ranges from 0.5 mm to 17.0 mm, the thickness of the outermost surface layer is preferably 0.5 mm or more, more preferably 0.6 mm or more, and even more preferably 0.7 mm or more, and is preferably 2.5 mm or less, more preferably 2.3 mm or less, and even more preferably 2.1 mm or less. If the thickness of the outermost surface layer is 0.5 mm or more, the reinforcing effect by the outer layer material is greater, and if the thickness of the outermost surface layer is 2.5 mm or less, the inner layer can be relatively thickened and thus the effect of reducing the weight of the grip is greater.

The percentage ((thickness of outermost surface layer/thickness of cylindrical portion)×100) of the thickness of the outermost surface layer to the thickness of cylindrical portion is preferably 0.5% or more, more preferably 1.0% or more, and even more preferably 1.5% or more, and is preferably 99.0% or less, more preferably 98.0% or less, and even more preferably 97.0% or less. If the percentage is 0.5% or more, the reinforcing effect by the outer layer material is greater, and if the percentage is 99.0% or less, the inner layer can be relatively thickened and thus the effect of reducing the weight of the grip is greater.

[Material]

The material of the cylindrical portion is not particularly limited. The cylindrical portion can be formed from a rubber composition or a resin composition used in a conventional golf club grip.

The narrow groove region of the cylindrical portion is preferably formed from a rubber composition. If the narrow groove region is formed from the rubber composition, occurrence of chipping of the island portion can be suppressed. The rubber composition (hereinafter, sometimes referred to as "first rubber composition".) constituting the narrow groove region preferably contains a base rubber and a crosslinking agent.

Examples of the base rubber include a natural rubber (NR), an ethylene-propylene-diene rubber (EPDM), a butyl rubber (IIR), an acrylonitrile-butadiene rubber (NBR), a hydrogenated acrylonitrile-butadiene rubber (HNBR), a carboxy-modified acrylonitrile-butadiene rubber (XNBR), a carboxy-modified hydrogenated acrylonitrile-butadiene rubber (HXNBR), a butadiene rubber (BR), a styrene-butadiene rubber (SBR), a polyurethane rubber (PU), an isoprene rubber (IR), a chloroprene rubber (CR), and an ethylene-propylene rubber (EPM). These base rubbers may be used solely, or two or more of them may be used in combination.

The base rubber preferably contains a nonpolar rubber. If the base rubber contains the nonpolar rubber, even if sebum of the user adheres to the grip, the oil component can be absorbed by the grip. Thus, lowering in the anti-slipping performance by sebum of the user can be suppressed. The amount of the nonpolar rubber in the base rubber is preferably 50 mass % or more, more preferably 60 mass % or more, and even more preferably 70 mass % or more. The SP (solubility parameter) value of the nonpolar rubber is 7.7 or more and less than 8.7.

The SP value is a value calculated by a formula of Fedors (the following mathematical formula (1)) (Polymer Engineering and Science, Page 147, No. 2, Volume 14th, 1974) ($Pa^{1/2}$ (25° C.)).

$$\text{SP value}=(\Delta E/V)^{1/2}=(\Sigma\Delta ei/\Sigma\Delta vi)^{1/2} \quad (1)$$

[In the formula (1), ΔE represents an evaporation energy, V represents a molar volume, Δei represents an evaporation energy of atom or atomic group, and Δvi represents a molar volume of atom or atomic group.]

Examples of the nonpolar rubber include a diene rubber such as isoprene rubber (IR), butadiene rubber (BR), styrene-butadiene rubber (SBR), chloroprene rubber (CR), and natural rubber (NR); and a non-diene rubber such as ethylene-propylene rubber (EPM), ethylene-propylene-diene rubber (EPDM), and butyl rubber (IIR). The nonpolar rubber may be used solely, or two or more of them may be used in combination. Among them, the diene rubber is preferable. The amount of the diene rubber in the nonpolar rubber is preferably 50 mass % or more, more preferably 60 mass % or more. It is also preferable that the nonpolar rubber consists of the diene rubber. As the nonpolar rubber, NR, EPDM, IIR, and SBR are more preferable.

The first rubber composition preferably contains the natural rubber as the base rubber. If the natural rubber is contained, the softness of the island portion is maintained even under a cold condition, and the high anti-slipping performance can be maintained. When the natural rubber is used as the base rubber, the amount of the natural rubber in the base rubber is preferably 50 mass % or more, more preferably 55 mass % or more, and even more preferably 60 mass % or more.

As the crosslinking agent, a sulfur crosslinking agent and an organic peroxide can be used. Examples of the sulfur crosslinking agent include an elemental sulfur and a sulfur donor type compound. Examples of the elemental sulfur include powdery sulfur, precipitated sulfur, colloidal sulfur, and insoluble sulfur. Examples of the sulfur donor type compound include 4,4'-dithiobismorpholine. Examples of the organic peroxide include dicumyl peroxide, α,α'-bis(t-butylperoxy-m-diisopropyl) benzene, 2,5-dimethyl-2,5-di(t-butylperoxy) hexane, and 1,1-bis(t-butylperoxy)-3,3,5-trimethylcyclohexane. The crosslinking agent may be used solely, or two or more of them may be used in combination. As the crosslinking agent, the sulfur crosslinking agent is preferred, and the elemental sulfur is more preferred. The amount of the crosslinking agent is preferably 0.2 part by mass or more, more preferably 0.4 part by mass or more, and even more preferably 0.6 part by mass or more, and is preferably 4.0 parts by mass or less, more preferably 3.5 parts by mass or less, and even more preferably 3.0 parts by mass or less, with respect to 100 parts by mass of (A) the base rubber.

The first rubber composition preferably further contains a vulcanization accelerator or a vulcanization activator.

Examples of the vulcanization accelerator include thiurams such as tetramethylthiuram disulfide (TMTD), tetrabenzylthiuram disulfide (TBzTD), tetramethylthiuram monosulfide (TMTM), and dipentamethylenethiuram tetrasulfide; guanidines such as diphenylguanidine (DPG); dithiocarbamates such as zinc dimethyldithiocarbamate (ZnPDC), and zinc dibutyldithiocarbamate; thioureas such as trimethylthiourea, and N,N'-diethylthiourea; thiazoles such as mercaptobenzothiazole (MBT), and benzothiazole disulfide; and sulfenamides such as N-cyclohexyl-2-benzothiazolylsulfenamide (CBS), and N-t-butyl-2-benzothiazolylsulfenamide (BBS). These vulcanization accelerators may be used solely, or two or more of them may be used in combination. The total amount of the vulcanization accelerator is preferably 0.4 part by mass or more, more preferably 0.8 part by mass or more, and even more preferably 1.2 parts by mass or more, and is preferably 8.0 parts by mass or less, more preferably 7.0 parts by mass or less, and even more preferably 6.0 parts by mass or less, with respect to 100 parts by mass of the base rubber.

Examples of the vulcanization activator include a metal oxide (excluding titanium oxide), a metal peroxide, and a fatty acid. Examples of the metal oxide include zinc oxide, magnesium oxide, and lead oxide. Examples of the metal peroxide include zinc peroxide, chrome peroxide, magnesium peroxide, and calcium peroxide. Examples of the fatty acid include stearic acid, oleic acid, and palmitic acid. These vulcanization activators may be used solely, or two or more of them may be used in combination. The total amount of the vulcanization activator is preferably 0.5 part by mass or more, more preferably 0.6 part by mass or more, and even more preferably 0.7 part by mass or more, and is preferably 10.0 parts by mass or less, more preferably 9.5 parts by mass or less, and even more preferably 9.0 parts by mass or less, with respect to 100 parts by mass of the base rubber.

The first rubber composition may further contain an antioxidant, a softening agent, a coloring agent, an anti-scorching agent, a resin, or the like, where necessary.

Examples of the antioxidant include imidazoles, amines, phenols and thioureas. Examples of the imidazoles include nickel dibutyldithiocarbamate (NDIBC), 2-mercaptobenzimidazole, and zinc salt of 2-mercaptobenzimidazole. Examples of the amines include phenyl-α-naphtylamine. Examples of the phenols include 2,2'-methylene bis(4-methyl-6-t-butylphenol) (MBMBP), and 2,6-di-tert-butyl-4-methylphenol. Examples of the thioureas include tributyl thiourea, and 1,3-bis(dimethylaminopropyl)-2-thiourea. These antioxidants may be used solely, or two or more of them may be used in combination. The amount of the antioxidant is preferably 0.2 part by mass or more, more preferably 0.3 part by mass or more, and even more preferably 0.4 part by mass or more, and is preferably 5.0 parts by mass or less, more preferably 4.8 parts by mass or less, and even more preferably 4.6 parts by mass or less, with respect to 100 parts by mass of the base rubber.

Examples of the softening agent include a mineral oil and a plasticizer. Examples of the mineral oil include paraffin oil, naphthene oil, and aromatic oil. Examples of the plasticizer include dioctyl phthalate, dibutyl phthalate, dioctyl sebacate, and dioctyl adipate.

Examples of the anti-scorching agent include an organic acid and a nitroso compound. Examples of the organic acid include phthalic anhydride, pyromellitic anhydride, trimellitic anhydride, benzoic acid, salicylic acid, and malic acid. Examples of the nitroso compound include N-nitrosodiphenylamine, N-(cyclohexylthio)phthalimide, sulfonamide derivative, diphenyl urea, bis(tridecyl)pentaerythritol diphosphite, and 2-mercaptobenzimidazole.

Examples of the resin include a hydrogenated rosin ester, a disproportionated rosin ester, an ethylene-vinyl acetate copolymer, a coumarone resin, a phenolic resin, a xylene resin, and a styrene resin.

The first rubber composition may be prepared by a conventional method. For example, the first rubber composition may be prepared by kneading materials with a kneading machine such as a Banbury mixer, a kneader and an open roll.

The material hardness (Shore A hardness) of the first rubber composition is preferably 40 or more, more preferably 42 or more, and even more preferably 45 or more, and is preferably 60 or less, more preferably 58 or less, and even more preferably 55 or less. If the material hardness (Shore A hardness) of the first rubber composition is 40 or more, the mechanical strength of the narrow groove region is further enhanced, and if the material hardness (Shore A hardness) of the first rubber composition is 60 or less, the outermost surface layer is not excessively hard, and thus the grip feeling when holding the grip is better.

In the single layered cylindrical portion or the outermost surface layer of the multiple layered cylindrical portion, the material of the other region than the narrow groove region is not particularly limited, but the other region is preferably formed from the first rubber composition. It is noted that the rubber composition constituting the other region may be identical to or different from the rubber composition constituting the narrow groove region. If they are identical to each other, the production of the cylindrical portion or outermost surface layer is easier.

When the cylindrical portion is multiple layered, the material of the inner layer is not particularly limited. Examples of the composition for forming the inner layer (hereinafter, sometime referred to as "second composition".) include a second rubber composition, and a resin composition.

The second rubber composition preferably contains a base rubber and a crosslinking agent. Examples of the base rubber include a natural rubber (NR), an ethylene-propylene-diene rubber (EPDM), a butyl rubber (IIR), an acrylonitrile-butadiene rubber (NBR), a hydrogenated acrylonitrile-butadiene rubber (HNBR), a carboxy-modified acrylonitrile-butadiene rubber (XNBR), a carboxy-modified hydrogenated acrylonitrile-butadiene rubber (HXNBR), a butadiene rubber (BR), a styrene-butadiene rubber (SBR), a polyurethane rubber (PU), an isoprene rubber (IR), a chloroprene rubber (CR), and an ethylene-propylene rubber (EPM). Among them, as the base rubber, NR, EPDM, IIR, NBR, HNBR, XNBR, HXNBR, BR, SBR and PU are preferable.

Examples of the crosslinking agent used in the second rubber composition include the same one as those employed in the first rubber composition, and the elemental sulfur is preferable. The second rubber composition preferably further contains a vulcanization accelerator and a vulcanization activator. Examples of these vulcanization accelerator and vulcanization activator include the same one as those employed in the first rubber composition. As the vulcanization accelerator, N-t-butyl-2-benzothiazolylsulfenamide and tetrabenzylthiuram disulfide are preferable. As the vulcanization activator, zinc oxide and stearic acid are preferable The second rubber composition may further contain a reinforcing material, an antioxidant, a softening agent, a coloring agent, an anti-scorching agent, or the like, where necessary. Examples of the reinforcing material, antioxidant, and coloring agent include the same one as those employed in the first rubber composition. As the reinforcing material, carbon black or silica is preferable. As the antioxidant, 2,2'-methylene bis(4-methyl-6-t-butylphenol) is preferable.

The second rubber composition may be prepared by a conventional method. For example, the second rubber composition may be prepared by kneading materials with a kneading machine such as a Banbury mixer, a kneader and an open roll. The temperature (material temperature) performing the kneading preferably ranges from 70° C. to 160° C. It is noted that when the second rubber composition contains microballoons, the kneading is preferably performed at a temperature lower than the expansion stating temperature of the microballoons.

The resin composition contains a base resin. Examples of the base resin include a polyurethane resin, a polystyrene resin, a polyethylene resin, a polypropylene resin, an ethylene-vinyl acetate copolymer resin, and a polyethylene terephthalate resin.

The second composition for forming the other portion is preferably the second rubber composition, and preferably contains the natural rubber (NR), ethylene-propylene-diene rubber (EPDM) or butyl rubber (IIR) as the base rubber. If the composition for forming the other portion contains the natural rubber (NR), ethylene-propylene-diene rubber (EPDM) or butyl rubber (IIR), the adhesion between the portion formed from the first rubber composition and the other portion is enhanced.

The inner layer may be a solid layer or a porous layer. If the inner layer is the porous layer, the golf club grip has a light weight. The porous layer is a layer having a plurality of fine pores (voids) formed in the rubber which is the base material. If a plurality of fine pores is formed, the layer has a low apparent density, and thus the golf club grip has a light weight.

Examples of the method producing the porous layer include a balloon forming method, chemical forming method, supercritical carbon dioxide injection molding method, salt extraction method, and solvent removing method. In the balloon forming method, microballoons are allowed to be contained in the rubber composition, and then be expanded by heating to perform forming. In addition, the expanded microballoons may be blended in the rubber composition, and then the resultant rubber composition is molded. In the chemical forming method, a foaming agent (such as azodicarbonamide, azobisisobutyronitrile, N,N'-dinitrosopentamethylenetetramine, p-toluenesulfonyl hydrazine, and p-oxybis(benzenesulfonohydrazide)) and a forming auxiliary are allowed to be contained in the rubber composition, and then a gas (such as carbon dioxide gas and nitrogen gas) is generated by a chemical reaction to perform forming. In the supercritical carbon dioxide injection molding method, the rubber composition is immersed in carbon dioxide being in a supercritical state at a high pressure, the resultant rubber composition is injected at a normal pressure, and carbon dioxide is gasified to perform forming. In the salt extraction method, a soluble salt (such as boric acid and calcium chloride) is allowed to be contained in the rubber composition, and then the salt is dissolved and extracted after molding to form fine pores. In the solvent removing method, a solvent is allowed to be contained in the rubber composition, and then the solvent is removed after molding to form fine pores.

When the inner layer is a porous layer, a formed layer formed from a second rubber composition containing a foaming agent is preferred. In particular, a formed layer formed by the balloon forming method is preferred. In other words, the inner layer is preferably a formed layer formed from the second rubber composition containing microballoons. If microballoons are used, the inner layer has a light weight while maintaining the mechanical strength thereof.

As the microballoons, organic microballoons or inorganic microballoons may be used. Examples of the organic microballoons include hollow particles formed from a thermoplastic resin, and resin capsules encapsulating a hydrocarbon having a low boiling point in a shell formed from a thermoplastic resin. Specific examples of the resin capsules include Expancel (registered trademark) manufactured by Akzo Nobel Company, and Matsumoto Microsphere (registered trademark) manufactured by Matsumoto Yushi Seiyaku Co., Ltd. Examples of the inorganic microballoons include hollow glass particles (such as silica balloons and alumina balloons), and hollow ceramic particles.

The volume average particle size of the resin capsule (before expansion) is preferably 5 μm or more, more preferably 6 μm or more, and even more preferably 9 μm or more, and is preferably 90 μm or less, more preferably 70 μm or less, and even more preferably 60 μm or less.

When the inner layer is produced by the balloon forming method, the amount of the microballoons in the second composition is preferably 5 parts by mass or more, more preferably 8 parts by mass or more, and even more preferably 12 parts by mass or more, and is preferably 20 parts by mass or less, more preferably 18 parts by mass or less, and even more preferably 15 parts by mass or less, with respect to 100 parts by mass of the base rubber. If the amount of the microballoons is 5 parts by mass or more, the grip has a lighter weight, and if the amount of the microballoons is 20 parts by mass or less, lowering in the mechanical strength of the inner layer can be suppressed.

In addition, the forming ratio of the inner layer prepared by the balloon forming method is preferably 1.2 or more, more preferably 1.5 or more, and even more preferably 1.8 or more, and is preferably 5.0 or less, more preferably 4.5 or less, and even more preferably 4.0 or less. If the forming ratio is 1.2 or more, the grip has a lighter weight, and if the forming ratio is 5.0 or less, lowering in the mechanical strength of the inner layer can be suppressed.

The material hardness (Shore A hardness) of the second rubber composition is preferably 20 or more, more preferably 25 or more, and even more preferably 30 or more, and is preferably 60 or less, more preferably 58 or less, and even more preferably 55 or less. If the material hardness (Shore A hardness) of the second rubber composition is 20 or more, the inner layer is not excessively soft and thus a tightly fixed touch feeling can be obtained when holding the grip, and if the material hardness (Shore A hardness) of the second rubber composition is 55 or less, the inner layer is not excessively hard, and thus the grip feeling when holding the grip is better.

The golf club grip may be obtained by molding the first rubber composition in a mold. Examples of the molding method include a press molding method and an injection molding method. In addition, the golf club grip having an inner layer and an outer layer may be obtained, for example, by press molding a laminated product composed of an unvulcanized rubber sheet formed from the first rubber composition and an unvulcanized rubber sheet formed from the second rubber composition in a mold. When the press molding method is adopted, the temperature of the mold preferably ranges from 140° C. to 200° C., the molding time preferably ranges from 5 minutes to 40 minutes, and the molding press preferably ranges from 0.1 MPa to 100 MPa Examples of the shape of the golf club grip include a shape having a cylindrical portion for inserting a shaft, and an integrally molded cap portion for covering the opening of the back end of the cylindrical portion. The cylindrical portion is formed from the first rubber composition. Further, the cylindrical portion preferably has a laminated construction composed of the inner layer and the outer layer. In this case, the outer layer is formed from the first rubber composition.

The cylindrical portion may be formed with a fixed thickness in the axis direction, or may be formed with a thickness gradually becoming thicker from the front end toward the back end. In addition, the cylindrical portion may be formed with a fixed thickness in the diameter direction, or a projecting strip portion (so-called back line) may be formed on a part of the cylindrical portion. Furthermore, a groove may be formed on the surface of the cylindrical portion. Formation of a water film between the hand of the golfer and the grip may be suppressed by the groove, and thus the grip performance under a wet condition is further enhanced. In addition, in view of the anti-slipping performance and abrasion resistance of the grip, a reinforcing cord may be disposed in the grip.

The mass of the golf club grip is preferably 16 g or more, more preferably 18 g or more, and even more preferably 20 g or more, and is preferably 35 g or less, more preferably 32 g or less, and even more preferably 30 g or less.

[Golf Club]

A golf club using the above golf club grip is also included in the present invention. The golf club comprises a shaft, a head provided on one end of the shaft, and a grip provided on another end of the shaft, wherein the grip is the above golf club grip. The shaft can be made of stainless steel or a carbon fiber reinforced resin. Examples of the head include a wood type, a utility type, and an iron type. The material constituting the head is not particularly limited, and examples thereof include titanium, titanium alloy, carbon fiber reinforced plastic, stainless steel, maraging steel and soft iron.

Figure 8:
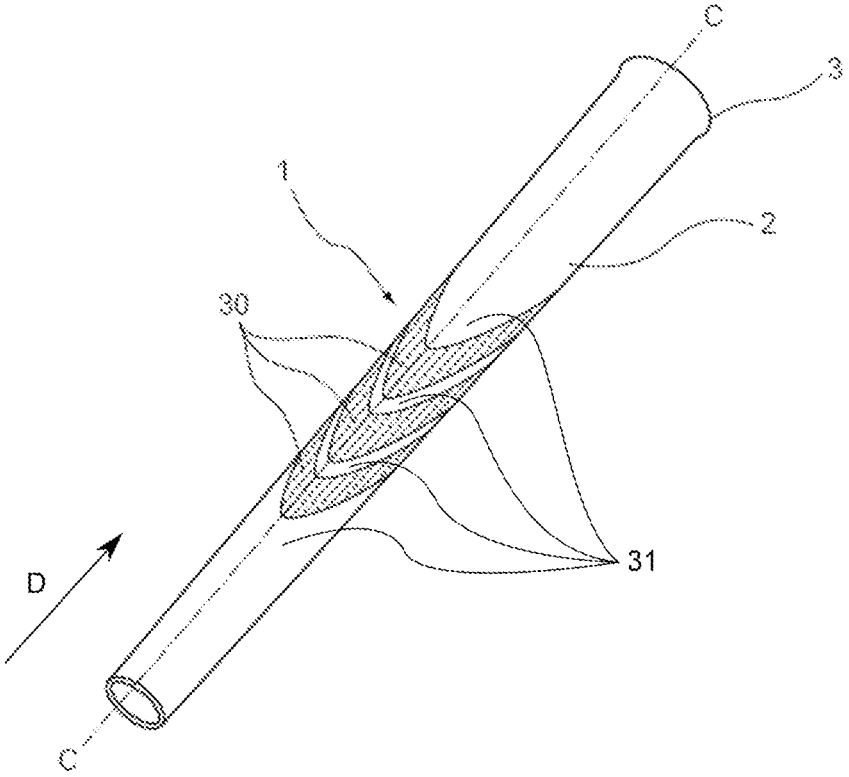
FIG. 8 is a perspective view showing one example of a golf club grip.

Next, the golf club grip and the golf club will be explained with reference to figures. FIG. 8 is a perspective view showing one example of a golf club grip. A grip 1 has a cylindrical portion 2 for inserting a shaft, and an integrally molded cap portion 3 for covering the opening of the back end of the cylindrical portion. A narrow groove region 30 is formed at a range of from 10% to 60% of the cylindrical portion. The narrow groove region 30 is continuously formed in a V shape in the peripheral direction.

Figure 9:
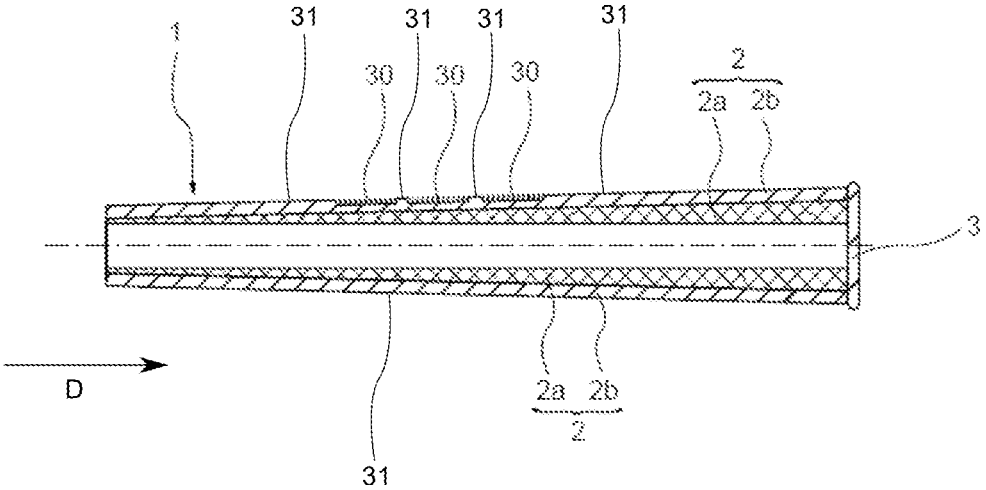
FIG. 9 is a schematic C-C cross-sectional view of the golf club grip shown in FIG. 8.
Figure 10:
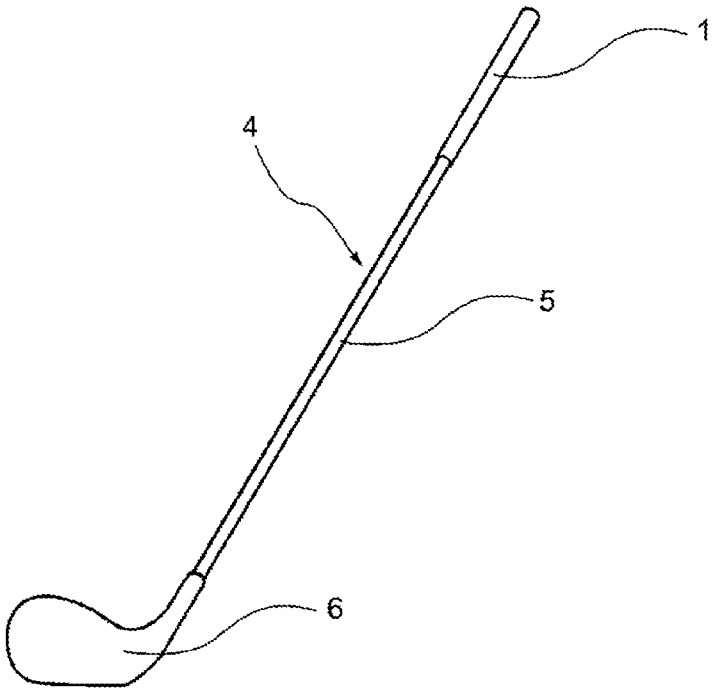
FIG. 10 is a perspective view showing one example of a golf club.

FIG. 9 is a schematic C-C cross-sectional view of the golf club grip shown in FIG. 8. A cylindrical portion 2 is composed of an inner layer 2*a* and an outer layer 2*b*. The outer layer 2*b* is formed with a uniform thickness throughout the entire region from the front end to the back end. The inner layer 2*a* is formed with a thickness gradually becoming thicker from the front end toward the back end. In the grip 1 shown in FIG. 9, the cap portion 3 is formed from the same rubber composition as the outer layer 2*b*.

FIG. 12 is a perspective view showing one example of the golf club according to the present invention. A golf club 4 comprises a shaft 5, a head 6 provided on one end of the shaft 5, and a grip 1 provided on another end of the shaft 5. The back end of the shaft 5 is inserted into the cylindrical portion 2 of the grip 1.

EXAMPLES

Next, the present invention will be described in detail by way of examples. However, the present invention is not limited to the examples described below. Various changes and modifications without departing from the spirit of the present invention are included in the scope of the present invention.

[Evaluation Method]

(1) Material Hardness (Shore a Hardness)

Sheets with a thickness of about 2 mm were produced by pressing the rubber composition at 160° C. for 8 to 20 minutes. It is noted that when the rubber composition contains the microballoons, the sheets were formed by expanding the microballoons in the same forming ratio as that when forming the grip. The sheets were stored at 23° C. for two weeks. At least three of these sheets were stacked on one another so as not to be affected by the measuring substrate on which the sheets were placed, and the hardness of the stack was measured with an automatic hardness tester (Digitest II, available from Bareiss company) using a testing device of "Shore A".

(2) Dynamic Frictional Coefficient

The dynamic frictional coefficient was measured with a static-dynamic friction tester (TL201 Ts available from Trinity-Lab Inc.). Specifically, a rubber sheet (width: 2 cm, length: 6 cm) was cut from the golf club grip, and the rubber sheet was adopted as the test piece. The rubber sheet was cut from the portion of the grip where the narrow groove region (narrow groove region for the grips No. 1 to 18, and groove region for the grips No. 19 to 23) was formed. It is noted that regarding the grip No. 24, no narrow groove region was formed, thus the rubber sheet was cut from the central portion of the grip in the axis direction. The test piece was fixed to a moving table of an apparatus, and a tactile contact having a geometric fingerprint pattern formed was used to measure the dynamic friction of the narrow groove region or groove region of the test piece. The test was performed at a moving distance of 1 cm, a moving speed of 1 mm/sec, and a load of 25 g. The dynamic frictional coefficient was an average value measured at a region of from 0.35 cm to 0.65 cm when a position where the friction movement started was adopted as 0 cm. It is noted that the dynamic frictional coefficient of the grip No. 24 was defined as an index of 100, and the dynamic frictional coefficient is a value represented by converting the dynamic frictional coefficient of each grip into this index.

(3) Feeling Evaluation

The grip was provided to a shaft to produce a golf club. Regarding the golf club, a feeling test was performed by ten golfers. The feeling evaluation was performed by taking the grip No. 24 as a standard, and evaluating if the grip was felt to have a better feeling than the grip No. 24 or not. When there were eight or more golfers thought the feeling was better, the feeling was evaluated as "G", and when there were seven or less golfers thought the feeling was better, the feeling was evaluated as "P".

(4) Feeling Evaluation when Grip is Wet

The grip was provided to a shaft to produce a golf club. Regarding the golf club, a feeling test when the grip was wet was performed by ten golfers. The feeling evaluation when the grip was wet was performed by hitting with the golf club before the grip was wetted and after the grip was wetted, and evaluating if a difference in the feeling was felt or not by the wetting of the grip. When there were eight or more golfers thought there was no difference, the feeling was evaluated as "G", and when there were seven or less golfers thought there was no difference, the feeling was evaluated as "P".

(5) Durability

The grip was provided to a shaft to produce a golf club. Regarding the golf club, a durability evaluation by an actual hitting for 1000 times was performed. The island portion of the narrow groove region or groove region of the grip after the hitting was observed. When chipping was found in the island portion, the durability was evaluated as "P", and when chipping was not found in the island portion, the durability was evaluated as "G".

(6) Head Speed

A grip of a golf club (driver) (XXIO8 (FLEX: S) available from Sumitomo Rubber Industries, Ltd.) was replaced with the grip which was the test object, to produce a test golf club. Regarding the golf club, an actual hitting evaluation was performed by ten golfers, and the head speed was measured. The head speed was measured with the measuring system described in Japanese Patent Publication No. 2012-170532 A, and an average value of ten golfers was calculated. It is noted that the head speed was shown in a difference from the head speed of the grip No. 24.

[Preparation of Grip Composition]

The materials having the formulations shown in Tables 1 and 2 were kneaded to prepare the outer layer rubber compositions and the inner layer rubber compositions. It is noted that, the outer layer rubber compositions were prepared by kneading all the materials with a Banbury mixer, and the inner layer rubber compositions were prepared by kneading the materials except the microballoons with a Banbury mixer followed by blending the microballoons therein with a roll. The material temperature when kneading the inner layer rubber compositions with the Banbury mixer and the material temperature when blending the microballoons with the roll were lower than the expansion starting temperature of the microballoons.

TABLE 1

| Outer layer rubber composition No. | | | A |
|---|---|---|---|
| Formulation (parts by mass) | Base rubber | NR | 70 |
| | | EPDM | 30 |
| | | IIR | 5 |
| | Reinforcing material | DIABLACK N220 | 4 |
| | | ULTRASIL VN3 GR | 8 |
| | Crosslinking agent | Sulfur | 2 |
| | Vulcanization accelerator | NOCCELER NS | 1 |
| | | NOCCELER CZ | 1 |
| | | SOXINOL D | 1 |
| | Vulcanization activator | Zinc oxide | 3 |
| | Antioxidant | NOCRAC NS-6 | 0.5 |
| | Processing aid and modifier | Stearic acid | 1 |
| | | PW380 | 2 |
| | Material hardness (Shore A) | | 53 |

TABLE 2

| Inner layer rubber composition No. | | | a |
|---|---|---|---|
| Formulation (parts by mass) | Base rubber | NR | 70 |
| | | EPDM | 30 |
| | | IIR | 5 |
| | Reinforcing material | DIABLACK N220 | 4 |
| | | ULTRASIL VN3 GR | 8 |
| | Crosslinking agent | Sulfur | 2 |
| | Vulcanization accelerator | NOCCELER NS | 1 |
| | | NOCCELER CZ | 1 |
| | | SOXINOL D | 1 |
| | Vulcanization activator | Zinc oxide | 3 |
| | Antioxidant | NOCRAC NS-6 | 0.5 |
| | Retarder | Santogard PVI | 0.5 |
| | | Benzoic acid | 0.3 |
| | Processing aid and modifier | Stearic acid | 1 |
| | | PW380 | 2 |
| | Foaming agent | Microballoons | 12 |
| | Material hardness (Shore A) | | 26 |

The materials used in Tables 1 and 2 are shown as follows.

NR (natural rubber): TSR20

EPDM (ethylene-propylene-diene rubber): ESPRENE (registered trademark) 505A available from Sumitomo Chemical Co., Ltd.

IIR: JSR BUTYL 065 available from JSR Corporation

DIABLACK (registered trademark) N220: carbon black (DBP absorption amount: 115 $cm^3$/100 g) available from Mitsubishi Chemical Corporation ULTRASIL VN3 GR: granulated silica (irregular shape) (DBP absorption amount: 200 $cm^3$/100 g to 240 $cm^3$/100 g) available from EVONIK Industries Sulfur: 5% oil treated sulfur fine powder (200 mesh) available from Tsurumi Chemical Industry Co., Ltd.

NOCCELER NS: N-t-butyl-2-benzothiazolylsulfenamide available from Ouchi Shinko Chemical Industry Co., Ltd.

NOCCELER CZ: N-cyclohexyl-2-benzothiazolylsulfenamide available from Ouchi Shinko Chemical Industry Co., Ltd.

SOXINOL D: 1,3-diphenyl guanidine available from Sumitomo Chemical Co., Ltd.

Zinc oxide: WHITE SHEEL available from PT. INDO LYSAGHT

NOCRAC (registered trademark) NS-6: 2,2'-methylene bis(4-methyl-6-t-butylphenol) available from Ouchi Shinko Chemical Industry Co., Ltd.

Santogard PVI: N-cyclohexylthiophthalimide available from Sanshin Chemical Industry Co., Ltd.

Benzoic acid: available from Aldrich Corporation

Stearic acid: stearic acid beads "Tsubaki" available from NOF Corporation

PW380: Diana process oil PW380 available from Idemitsu Kosan Co., Ltd.

Microballoons: "Expancel (registered trademark) 909-80DU" (resin capsule encapsulating a hydrocarbon having a low boiling point in a shell formed from a thermoplastic resin, volume average particle size: 18 μm to 24 μm, expansion starting temperature: 120° C. to 130° C.) available from Akzo Nobel Company

[Production of Grip]

Grips No. 1 to 13 and 15 to 24

The unvulcanized outer layer rubber sheet having a fan shape and the cap member were prepared using the outer layer rubber composition. It is noted that the outer layer rubber sheet was formed with a fixed thickness. The unvulcanized inner layer rubber sheet having a rectangular shape was prepared using the inner layer rubber composition. It is noted that the inner layer rubber sheet was formed with a thickness gradually becoming thicker from one end toward another end. The inner layer rubber sheet was wound around a mandrel, an adhesive composition was applied to the inner layer rubber sheet, and then the outer layer rubber sheet was laminated and wound around thereon. The mandrel having these rubber sheets being wound therearound, and the cap member were charged into a mold. A heat treatment was performed at a mold temperature of 160° C. for 15 minutes to obtain grips having no narrow groove on the surface of the outer layer. In the obtained grips having no narrow groove, the cylindrical portion had a thickness of 1.5 mm at the thinnest part (the end on the head side), and a thickness of 6.7 mm at the thickest part (the end on the grip end side).

Grip No. 14

The unvulcanized rubber sheet having a fan shape and the cap member were prepared using the outer layer rubber composition. It is noted that the rubber sheet was formed with a thickness gradually becoming thicker from one end toward another end. The rubber sheet was wound around a mandrel, and the mandrel having the rubber sheet being wound therearound, and the cap member were charged into a mold. A heat treatment was performed at a mold temperature of 160° C. for 15 minutes to obtain grips having no narrow groove on the surface of the outer layer. In the obtained grips having no narrow groove, the cylindrical portion had a thickness of 1.5 mm at the thinnest part (the end on the head side), and a thickness of 6.7 mm at the thickest part (the end on the grip end side).

Grips No. 1 to 23

Regarding the above obtained grips having no narrow groove, grooves shown in Tables 3 to 5 were formed with a laser processing machine (fiber laser processing machine, "ML-7320DL", available from Amada Miyachi Co., Ltd.), to impart a narrow groove region or groove region to these grips. The formed ranges of the narrow groove region or groove region of each of the grips are shown as follows. It is noted that the tip side end of the cylindrical portion of the grip is adopted as 0%, and the bat side end of the cylindrical portion of the grip is adopted as 100%. The narrow groove region or groove region was formed at a range of from 20% to 100% for the grips No. 1 to 9, 14 to 17 and 19 to 22; at a range of from 26% to 36% for the grip No. 10; at a range of from 18% to 58% for the grips No. 11 and 23; at a range of from 18% to 78% for the grip No. 12; and a range of from 0% to 100% for the grip No. 13. It is noted that at the above range, the narrow groove region or groove region was formed at the entire circumference of the cylindrical portion. Evaluation results regarding each of the grips are shown in Tables 3 to 5.

| Grip No. | | 1 | 2 | 3 | 4 | 5 | 6 | 7 | 8 | 9 |
|---|---|---|---|---|---|---|---|---|---|---|
| Outer layer | Rubber composition No. | A | A | A | A | A | A | A | A | A |
| | Type | Solid | Solid | Solid | Solid | Solid | Solid | Solid | Solid | Solid |
| | Thickness (mm) | 0.2 | 0.2 | 0.2 | 0.2 | 0.2 | 0.2 | 0.2 | 0.2 | 0.2 |

-continued

| Grip No. | | | 1 | 2 | 3 | 4 | 5 | 6 | 7 | 8 | 9 |
|---|---|---|---|---|---|---|---|---|---|---|---|
| Inner layer | | Rubber composition No. | a | a | a | a | a | a | a | a | a |
| | | Type | Foamed | Foamed | Foamed | Foamed | Foamed | Foamed | Foamed | Foamed | Foamed |
| | | Foaming ratio | 3.3 | 3.3 | 3.3 | 3.3 | 3.3 | 3.3 | 3.3 | 3.3 | 3.3 |
| Narrow groove region | First narrow groove group | Width w1 (mm) | 0.2 | 0.3 | 0.5 | 0.5 | 0.5 | 0.5 | 0.1 | 0.3 | 0.7 |
| | | Depth h1 (mm) | 0.3 | 0.3 | 0.4 | 0.3 | 0.7 | 1.0 | 0.3 | 0.3 | 0.3 |
| | | Interval d1 (mm) | 0.3 | 0.8 | 1.0 | 1.2 | 1.5 | 1.0 | 0.4 | 1.0 | 1.0 |
| | | Ratio (d1/w1) | 1.5 | 2.7 | 2.0 | 2.4 | 3.0 | 2.0 | 4.0 | 3.3 | 1.4 |
| | Second narrow groove group | Width w2 (mm) | 0.2 | 0.3 | 0.5 | 0.5 | 0.5 | 0.5 | 0.1 | 0.3 | 0.7 |
| | | Depth h2 (mm) | 0.3 | 0.3 | 0.4 | 0.3 | 0.7 | 1.0 | 0.3 | 0.3 | 0.3 |
| | | Interval d2 (mm) | 0.3 | 0.8 | 1.0 | 1.0 | 1.2 | 1.5 | 1.0 | 0.4 | 1.0 |
| | | Ratio (d2/w2) | 1.5 | 2.7 | 2.0 | 2.4 | 3.0 | 2.0 | 4.0 | 8.3 | 1.4 |
| | Angle formed between first narrow groove group and second narrow groove group (°) | | 90 | 90 | 90 | 90 | 90 | 90 | 90 | 90 | 90 |
| | Occupation ratio of narrow groove per 25 mm$^2$ (%) | | 64.0 | 42.2 | 51.0 | 48.2 | 36.0 | 51.0 | 36.0 | 36.0 | 64.0 |
| | Island portion | Shape in plan view | Square | Square | Square | Square | Square | Square | Square | Square | Square |
| | | Stereo shape | Truncated quadrangular pyramid | Truncated quadrangular pyramid | Truncated quadrangular pyramid | Truncated quadrangular pyramid | Truncated quadrangular pyramid | Truncated quadrangular pyramid | Truncated quadrangular pyramid | Truncated quadrangular pyramid | Truncated quadrangular pyramid |
| | Area ratio (%) in range of from 10% to 60% of cylindrical portion | | 100 | 100 | 100 | 100 | 100 | 100 | 100 | 100 | 100 |
| | Total area (mm$^2$) | | 26087 | 26087 | 26087 | 26087 | 26087 | 26087 | 26087 | 26087 | 26087 |
| Evaluation | Mass (g) | | 23 | 23 | 23 | 23 | 23 | 23 | 23 | 23 | 23 |
| | Dynamic frictional coefficient | | 121 | 116 | 111 | 109 | 110 | 108 | 120 | 112 | 108 |
| | Feeling | | G | G | G | G | G | G | G | G | G |
| | Feeling when grip is wet | | G | G | G | G | G | G | G | G | G |
| | Durability | | G | G | G | G | G | G | G | G | G |
| | Head speed (m/s) | | 0.31 | 0.26 | 0.23 | 0.16 | 0.18 | 0.18 | 0.29 | 0.21 | 0.15 |

| Grip No. | | | 10 | 11 | 12 | 13 | 14 | 15 | 16 | 17 | 18 |
|---|---|---|---|---|---|---|---|---|---|---|---|
| Outer layer | | Rubber composition No. | A | A | A | A | None | A | A | A | A |
| | | Type | Solid | Solid | Solid | Solid | | Solid | Solid | Solid | Solid |
| | | Thickness (mm) | 0.2 | 0.2 | 0.2 | 0.2 | | 0.2 | 0.2 | 0.2 | 0.2 |
| Inner layer | | Rubber composition No. | a | a | a | a | A | a | a | a | a |
| | | Type | Foamed | Foamed | Foamed | Foamed | Solid | Foamed | Foamed | Foamed | Foamed |
| | | Foaming ratio | 3.3 | 3.3 | 3.3 | 3.3 | — | 3.3 | 3.3 | 3.3 | 3.3 |
| Narrow groove region | First narrow groove group | Width w1 (mm) | 0.5 | 0.5 | 0.5 | 0.5 | 0.5 | 0.2 | 0.5 | 0.5 | 0.5 |
| | | Depth h1 (mm) | 0.3 | 0.3 | 0.1 | 0.2 | 0.5 | 0.3 | 0.3 | 0.3 | 0.3 |
| | | Interval d1 (mm) | 1.0 | 1.0 | 1.0 | 1.0 | 1.0 | 0.15 | 9.8 | 2.0 | 1.0 |
| | | Ratio (d1/w1) | 2.0 | 2.0 | 2.0 | 2.0 | 2.0 | 0.8 | 3.6 | 4.0 | 2.0 |
| | Second narrow groove group | Width w2 (mm) | 0.5 | 0.5 | 0.5 | 0.5 | 0.5 | 0.2 | 0.5 | 0.5 | 0.5 |
| | | Depth h2 (mm) | 0.3 | 0.3 | 0.1 | 0.2 | 0.5 | 0.3 | 0.3 | 0.3 | 0.3 |
| | | Interval d2 (mm) | 1.0 | 1.0 | 1.0 | 1.0 | 1.0 | 0.15 | 1.8 | 2.0 | 1.0 |
| | | Ratio (d2/w2) | 2.0 | 2.0 | 2.0 | 2.0 | 2.0 | 0.8 | 3.6 | 4.0 | 2.0 |
| | Angle formed between first narrow groove group and second narrow groove group (°) | | 90 | 90 | 90 | 90 | 90 | 90 | 90 | 90 | 90 |
| | Occupation ratio of narrow groove per 25 mm$^2$ (%) | | 51.0 | 51.0 | 51.0 | 51.0 | 51.0 | 80.6 | 36.0 | 36.0 | 51.0 |
| | Island portion | Shape in plan view | Square | Square | Square | Square | Square | Square | Square | Square | Square |
| | | Stereo shape | Truncated quadrangular pyramid | Truncated quadrangular pyramid | Truncated quadrangular pyramid | Truncated quadrangular pyramid | Truncated quadrangular pyramid | Truncated quadrangular pyramic | Truncated quadrangular pyramid | Truncated quadrangular pyramid | Truncated quadrangular pyramid |

-continued

| | Grip No. | 10 | 11 | 12 | 13 | 14 | 15 | 16 | 17 | 18 |
|---|---|---|---|---|---|---|---|---|---|---|
| | Area ratio (%) in range of from 10% to 60% of cylindrical portion | 20 | 80 | 100 | 100 | 100 | 100 | 100 | 100 | 10 |
| | Total area ($mm^2$) | 2804 | 11704 | 18056 | 34282 | 26087 | 26087 | 26087 | 26087 | 1383 |
| Evaluation | Mass (g) | 23 | 23 | 23 | 23 | 38 | 23 | 23 | 23 | 23 |
| | Dynamic frictional coefficient | 109 | 111 | 111 | 112 | 115 | 119 | 102 | 101 | 103 |
| | Feeling | G | G | G | G | G | G | P | P | P |
| | Feeling when grip is wet | G | G | G | G | G | G | G | G | P |
| | Durability | G | G | G | G | G | P | G | G | G |
| | Head speed (m/s) | 0.20 | 0.23 | 0.19 | 0.20 | 0.26 | 0.29 | 0.03 | 0 | 0.01 |

| | | Grip No. | 19 | 20 | 21 | 22 | 23 | 24 |
|---|---|---|---|---|---|---|---|---|
| Outer layer | | Rubber composition No. | A | A | A | A | A | A |
| | | Type | Solid | Solid | Solid | Solid | Solid | Solid |
| | | Thickness (mm) | 0.2 | 0.2 | 0.2 | 0.2 | 0.2 | 0.2 |
| Inner layer | | Rubber composition No. | a | a | a | a | a | a |
| | | Type | Foamed | Foamed | Foamed | Foamed | Foamed | Foamed |
| | | Foaming ratio | 3.3 | 3.3 | 3.3 | 3.3 | 3.3 | 3.3 |
| Groove region | First groove group | Width w1 (mm) | 0.05 | 1.0 | 1.5 | 0.5 | 0.5 | — |
| | | Depth h1 (mm) | 0.3 | 0.3 | 0.4 | 0.05 | 1.5 | — |
| | | Interval d1 (mm) | 1.0 | 1.0 | 1.0 | 1.0 | 1.0 | — |
| | | Ratio (d1/w1) | 20.0 | 1.0 | 0.7 | 2.0 | 2.0 | — |
| | Second groove group | Width w2 (mm) | 0.05 | 1.0 | 1.5 | 0.5 | 0.5 | — |
| | | Depth h2 (mm) | 0.3 | 0.3 | 0.4 | 0.5 | 1.5 | — |
| | | Interval d2 (mm) | 1.0 | 1.0 | 1.0 | 1.0. | 1.0 | — |
| | | Ratio (d2/w2) | 20.0 | 1.0 | 0.7 | 2.0 | 2.0 | — |
| | Angle between first groove group and second groove group (°) | | 90 | 90 | 90 | 90 | 90 | — |
| | Occupation ratio of groove per 25 $mm^2$ (%) | | 7.8 | 64.0 | 84.0 | 51.0 | 51.0 | — |
| | Island portion | Shape in plan view | Square | Square | Square | Square | Square | — |
| | | Stereo shape | Truncated quadrangular pyramid | Truncated quadrangular pyramid | Truncated quadrangular pyramid | Truncated quadrangular pyramid | Truncated quadrangular pyramid | — |
| | Area ratio (%) in range of from 10% to 60% of cylindrical portion | | 100 | 100 | 100 | 100 | 80 | — |
| | Total area ($mm^2$) | | 26087 | 26087 | 26087 | 26087 | 11704 | — |
| Evaluation | Mass (g) | | 23 | 23 | 23 | 23 | 23 | 23 |
| | Dynamic frictional coefficient | | 103 | 93 | 72 | 98 | 103 | 100 |
| | Feeling | | G | P | P | P | P | — |
| | Feeling when grip is wet | | P | G | G | P | G | P |
| | Durability | | G | G | P | G | P | G |
| | Head speed (m/s) | | 0.05 | −0.12 | −0.23 | 0.00 | −0.27 | 0.00 |

The grips No. 1 to 19 are cases that the grips have a narrow groove region comprising narrow grooves in an occupation ratio of 35% or more per 25 $mm^2$ at at least a part of the surface of the cylindrical portion. In particular, in the grips No. 1 to 14, an interval between the narrow grooves in the narrow groove region is 0.3 to 1.5 mm, and the narrow groove region has a total area of 1400 $mm^2$ or more. These grips No. 1 to 14 are excellent in the anti-slipping performance, feeling when the grip is wet and durability, and have an improved head speed.

The grip No. 15 has an interval of 0.15 mm between the narrow grooves, and is inferior in the durability. The grips No. 16 and 17 have an interval of 1.8 mm or 2.0 mm between the narrow grooves, are inferior in the feeling, and have an unimproved head speed. The grip No. 18 has the narrow groove region in a total area of 1383 $mm^2$, and is inferior in the feeling when the grip is wet. Further, although the grip No. 18 has the narrow groove region in a same pattern as the grips No. 10 and 11, the grip No. 18 has the narrow groove region in a smaller area than the grips No. 10 and 11, thus the grip No. 18 is considered to have a frictional coefficient different from the grips No. 10 and 11.

The grips No. 19 to 23 have a groove region comprising grooves in an occupation ratio of 35% or more per 25 $mm^2$ at the surface of the cylindrical portion.

However, the grip No. 19 has a groove width of less than 0.1 mm, and is inferior in the feeling when the grip is wet. The grips No. 20 and 21 have a groove width of more than 0.7 mm, are inferior in the anti-slipping performance and feeling, and have an unimproved head speed. The grip No. 22 has a groove depth of less than 0.1 mm, and is inferior in the feeling when the grip is wet. The grip No. 23 has a groove depth of more than 1.0 mm, and is inferior in the feeling and durability.

REFERENCE SIGNS LIST

1: grip, 2: cylindrical portion, 2*a*: inner layer, 2*b*: outer layer, 3: cap portion, 4: golf club, 5: shaft, 6: head, 10: first narrow groove group, 20: second narrow groove group, 30: narrow groove region, 31: other region than the narrow groove region, D: axis direction of cylindrical portion.

The invention claimed is:

1. A golf club grip comprising a cylindrical portion for inserting a shaft, wherein the cylindrical portion is formed from a first rubber composition containing a nonpolar rubber as a base rubber, the golf club grip has a narrow groove region comprising narrow grooves in an occupation ratio of 35% or more per 25 $mm^2$ at at least a part of a surface of the cylindrical portion, the narrow groove region has a total area of 1400 $mm^2$ or more, in the narrow groove region, an interval (d) between the narrow grooves is 1.5 mm or less, the narrow groove has a width (w) of from 0.1 mm to 0.7 mm and a depth (h) of from 0.1 mm to 1.0 mm, a cross-sectional shape of the narrow groove is a V shape, a roughly V shape, or a U shape, a ratio (wd/ws) of a width (wd) of the narrow groove at the deepest position to a width (ws) of the narrow groove at the grip surface is 0.8 or less, the narrow grooves have a first narrow groove group formed in parallel to each other, and a second narrow groove group intersecting with the first narrow groove group and formed in parallel to each other, and the angle formed between the first narrow groove group and the second narrow groove group is 45° or more and 135° or less.

2. The golf club grip according to claim 1, wherein when a tip side end of the cylindrical portion is adopted as 0%, and a bat side end of the cylindrical portion is adopted as 100%, the narrow groove region is formed at at least a part of a range of from 10% to 100% of the cylindrical portion.

3. The golf club grip according to claim 1, wherein in the narrow groove region, a ratio (d/w) of the interval (d) between the narrow grooves to the width (w) of the narrow groove ranges from 1 to 5.

4. The golf club grip according to claim 1, wherein the narrow groove region is formed of a plurality of narrow groove positions, an area of each narrow groove position is 180 $mm^2$ or more, each narrow groove position is continuously formed in the peripheral direction of the cylindrical portion, and the narrow groove positions are intermittently arranged in the axis direction of the cylindrical portion.

5. The golf club according to claim 4, wherein each narrow groove position is continuously formed in a V shape or U shape in the peripheral direction.

6. The golf club grip according to claim 1, wherein the angle formed between the first narrow groove group and the second narrow groove group is 90°.

7. The golf club grip according to claim 1, wherein an island portion is formed by separation of the narrow grooves and a shape of the island portion is a truncated quadrangular pyramid.

8. The golf club grip according to claim 1, wherein an average length of the narrow grooves is 10 mm or more.

9. A golf club comprising a shaft, a head provided on one end of the shaft, and a grip provided on another end of the shaft, wherein the grip is a golf club grip comprising a cylindrical portion for inserting the shaft, the cylindrical portion is formed from a first rubber composition containing a nonpolar rubber as a base rubber, the golf club grip has a narrow groove region comprising narrow grooves in an occupation ratio of 35% or more per 25 $mm^2$ at at least a part of a surface of the cylindrical portion, the narrow groove region has a total area of 1400 $mm^2$ or more, in the narrow groove region, an interval (d) between the narrow grooves is 1.5 mm or less, the narrow groove has a width (w) of from 0.1 mm to 0.7 mm and a depth (h) of from 0.1 mm to 1.0 mm, a cross-sectional shape of the narrow groove is a V shape, a roughly V shape, or a U shape, a ratio (wd/ws) of a width (wd) of the narrow groove at the deepest position to a width (ws) of the narrow groove at the grip surface is 0.8 or less, the narrow grooves have a first narrow groove group formed in parallel to each other, and a second narrow groove group intersecting with the first narrow groove group and formed in parallel to each other, and the angle formed between the first narrow groove group and the second narrow groove group is 45° or more and 135° or less.

10. The golf club according to claim 9, wherein when a tip side end of the cylindrical portion is adopted as 0%, and a bat side end of the cylindrical portion is adopted as 100%, the narrow groove region is formed at at least a part of a range of from 10% to 100% of the cylindrical portion.

11. The golf club according to claim 9, wherein in the narrow groove region, a ratio (d/w) of the interval (d) between the narrow grooves to the width (w) of the narrow groove ranges from 1 to 5.

12. The golf club according to claim 9, wherein the angle formed between the first narrow groove group and the second narrow groove group is 90°.

13. The golf club grip according to claim 9, wherein an island portion is formed by separation of the narrow grooves and a shape of the island portion is a truncated quadrangular pyramid.

14. The golf club grip according to claim 9, wherein an average length of the narrows groove is 10 mm or more.

15. A golf club grip comprising a cylindrical portion for inserting a shaft, wherein the cylindrical portion is formed from a first rubber composition containing a nonpolar rubber as a base rubber, the golf club grip has a narrow groove region and other region than the narrow groove region at a surface of the cylindrical portion, the narrow groove region has a total area of 1400 $mm^2$ or more, in the narrow groove region, an interval (d) between the narrow grooves is 1.5 mm or less, the narrow groove region comprises narrow grooves in an occupation ratio of 35% or more per 25 $mm^2$, the narrow groove has a width (w) of from 0.1 mm to 0.7 mm and a depth (h) of from 0.1 mm to 1.0 mm, a cross-sectional shape of the narrow groove is a V shape, a roughly V shape, or a U shape, a ratio (wd/ws) of a width (wd) of the narrow groove at the deepest position to a width (ws) of the narrow groove at the grip surface is 0.8 or less, the narrow grooves have a first narrow groove group formed in parallel to each other, and a second narrow groove group intersecting with the first narrow groove group and formed in parallel to each other, the angle formed between the first narrow groove group and the second narrow groove group is 45° or more and 135° or less, the narrow groove region is formed of a plurality of narrow groove positions, an area of each narrow groove position is 180 $mm^2$ or more, the narrow groove positions are intermittently arranged in the axis direction of the cylindrical portion, and the other region formed between the narrow groove regions is continuously formed in a V shape or U shape in the peripheral direction of the cylindrical portion.

16. The golf club grip according to claim 15, wherein an island portion is formed by separation of the narrow grooves and a shape of the island portion is a truncated quadrangular pyramid.

17. The golf club grip according to claim 15, wherein an average length of the narrow grooves is 10 mm or more.

18. A golf club grip comprising a cylindrical portion for inserting a shaft, wherein the cylindrical portion is formed from a first rubber composition containing a nonpolar rubber as a base rubber, the golf club grip has a narrow groove region comprising narrow grooves in an occupation ratio of 35% or more per 25 $mm^2$ at at least a part of a surface of the cylindrical portion, the narrow groove region has a total area of 1400 $mm^2$ or more, in the narrow groove region, an interval (d) between the narrow grooves is 1.5 mm or less, the narrow groove has a width (w) of from 0.1 mm to 0.7 mm and a depth (h) of from 0.1 mm to 1.0 mm, a cross-sectional shape of the narrow groove is a V shape, a roughly V shape, or a U shape, a ratio (wd/ws) of a width (wd) of the narrow groove at the deepest position to a width (ws) of the narrow groove at the grip surface is 0.8 or less, the narrow grooves have a first narrow groove group formed in parallel to each other, and a second narrow groove group intersecting with the first narrow groove group and formed in parallel to each other, the angle formed between the first narrow groove group and the second narrow groove group is 45° or more and 135° or less, the narrow groove region is formed of a plurality of narrow groove positions, an area of each narrow groove position is 180 $mm^2$ or more, at least a part of the narrow groove region is intermittently formed in the axis direction of the cylindrical portion.

19. The golf club grip according to claim 18, wherein an island portion is formed by separation of the narrow grooves and a shape of the island portion is a truncated quadrangular pyramid.

20. The golf club grip according to claim 18, wherein an average length of the narrow grooves is 10 mm or more.

* * * * *